US006395688B2

(12) United States Patent
Vidarsson

(10) Patent No.: US 6,395,688 B2
(45) Date of Patent: May 28, 2002

(54) LUBRICANT COMPOSITE AND PROCESS FOR THE PREPARATION THEREOF

(75) Inventor: Hilmar Vidarsson, Höganäs (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/768,571

(22) Filed: Jan. 25, 2001

Related U.S. Application Data

(63) Continuation of application No. PCT/SE00/01725, filed on Sep. 7, 2000.

(30) Foreign Application Priority Data

Sep. 10, 1999 (SE) ..... 9903245

(51) Int. Cl.[7] ..... C10L 105/68; B22F 1/02
(52) U.S. Cl. ..... 508/555; 508/554
(58) Field of Search ..... 508/554, 555; 75/252, 246

(56) References Cited

U.S. PATENT DOCUMENTS 5,468,401 A * 11/1995 Lum et al. ..... 72/42
5,476,534 A * 12/1995 Ogura et al. ..... 75/252
5,484,469 A * 1/1996 Rutz et al. ..... 75/255
6,231,635 B1 * 5/2001 Suzuki et al. ..... 75/252

FOREIGN PATENT DOCUMENTS

| | | |
|---|---|---|
| EP | 0 259 960 | 3/1988 |
| EP | 0 750 024 | 12/1996 |
| HU | 75498 | 5/1997 |
| WO | WO-98/05453 | * 2/1998 |

* cited by examiner

*Primary Examiner*—Jacqueline V. Howard
(74) *Attorney, Agent, or Firm*—Burns, Doane, Swecker & Mathis LLP

(57) ABSTRACT

The invention concerns a process for the preparation of a lubricant composite for powder metallurgy including the steps of selecting a first lubricant having a melting point above 120° C. and a second lubricant having a melting point below 110° C.;

mixing the lubricants at an elevated temperature in order to melt the lubricants and subjecting the mixture to rapid for providing a lubricant composite including a metastable phase. The invention also concerns the obtained lubricant composite.

9 Claims, No Drawings

LUBRICANT COMPOSITE AND PROCESS FOR THE PREPARATION THEREOF

This is a Continuation of International Application No. PCT/SE00/01725, filed Sep. 7, 2000 that designates the United States of America and was published under PCT Article 21(2) in English and claims priority for Application No. 990345-0 filed in Sweden on Sep. 10, 1999.

This invention relates to a lubricant composite for powder metallurgy and to the manufacture and use of this lubricant composite. More particularly the invention concerns a lubricant composite including a combination of at least two lubricants.

Powdered metals, for example, powdered iron, are used to make small, fairly intricate parts, for example, gears. The fabrication of such metallic parts by powdered metal technology involves the following steps:

- the powdered metal is blended with a lubricant and other additives to form a mixture,
- the obtained mixture is poured into a mould and compacted to form a part using a high pressure, usually of the order of 200 to 1000 MPa,
- the part is ejected from the mould and subjected to a high temperature to decompose and remove the lubricant,
- the part is heated to a higher temperature to cause all the particles of metal in the part to sinter together and,
- the part is cooled, after which it is ready for use.

Lubricants are added to metal powders for several reasons. One reason is that they facilitate the production of compacts for sintering by lubricating the interior of the powder during the compaction process. Through selection of proper lubricants higher densities, which is often required, can be obtained. Furthermore, the lubricants provide the necessary lubricating action that is needed to eject the compacted part out of the die. Insufficient lubrication will result in wear and scuffing at the die surface through the excessive friction during the ejection, resulting in premature die failure. The problems with insufficient lubrication can be solved in two ways; either by increasing the amount of the lubricant or by selecting more efficient lubricants. By increasing the amount of lubricant, an undesired side effect is however encountered in that the gain in density through better "internal lubrication" is reversed by the increasing volume of the lubricant. The better choice would then be to select more efficient lubricants.

The known high effective lubricating agents however have low melting points. This distinguishing feature results in problems already before the compaction process as regards the powder flow and the apparent density. A relatively free powder flow is essential for smooth operation in a production press, while a stable apparent density facilitates a high quality during the production. The parts are thus of equal weight and exhibit tight dimensional tolerances, reducing the need for post operations such as calibrations.

The use of very efficient lubricating agents have thus until now been limited due to their negative impact on powder properties. An object of the present invention is to provide a process for making these lubricants industrially useful.

In brief the process for making the new lubricant composites according to the invention includes the steps of

- selecting a first lubricant having a melting point or a substantial part of its melting below 110° C. and a second lubricant having a melting point or a substantial part of its melting above 120° C. ;
- mixing the lubricants at an elevated temperature in order to melt the lubricants and
- subjecting the mixture to rapid cooling for providing a metastable lubricant composite.

Examples of lubricants within the first group are saturated and unsaturated fatty acid amides and bis-amides, such as stearamide, oleamide and ethylene-bis-oleamide. The amount of this first lubricant depends on the specific lubricant and may vary between 5 and 75% by weight.

The second lubricant may be selected from lubricants presently used in powder metallurgy and preferably this lubricant is selected from the group consisting of fatty acid bis-amides, such as ethylene-bis-stearamide (EBS).

The mixture of the two types of lubricants are heated during mixing at a temperature above the melting point of the second lubricant for a time period sufficient to provide a homogenous mixture, which is then subjected to a rapid cooling which is a critical feature of the process according to the present invention.

The rapid cooling rate, can be achieved by several well-known methods, such as through pouring of the melt into liquid nitrogen or water, by atomisation of the material from the melt or by pouring the melt onto a cooled metal surface. The cooling rate necessary is dependent on the composition and may also vary with the relative amounts of the first and the second lubricant. For example, cooling rates above 100° C./s may be necessary for some compositions and amounts, whereas cooling rates about 1° C./s may be sufficient in other circumstances. In any case accelerated or forced cooling is necessary in order to achieve the metastable phase which is a distinguishing feature of the new lubricant composite according to the present invention and which makes it possible to take advantage of the valuable lubricating properties of relatively low melting lubricants, which in the form of the metastable phase retains the high lubricating effect but looses the negative influence on the flow.

Depending to the mode of preparation the solidified lubricant composite may then be disintegrated to a suitable particle size by e.g. milling. Preferred average particle sizes are between 3 and 150 $\mu$m.

A spherical shape is the most desirable, because this leads to the highest flow rates and apparent density When mixed with metal powders, the concentration of the lubricant composite plus optional conventional solid lubricants, is suitably in the range of 0.1 to 5% by weight, preferably from 0.3 to 1% by weight.

The following non limiting example illustrates the invention.

Iron powder mixes were prepared by using lubricant compositions prepared by different methods. The lubricants were composed of the common recipy of 75% ethylene-bis-stearamide (EBS available as Hoechst wax from Hoechst AG, Germany) having a melting point of about 145° C. and 25% oleamide (available from Croda) having a melting point of about 70° C. The iron powder was ASC100.29 (available from Höganäs AB, Sweden) and 0.5% by weight of graphite was mixed with the iron powder.

The first lubricant composition was prepared by micronizing the two ingredients separately down to average particle sizes below 30 $\mu$m and subsequently admixing to the iron powder mixture.

The second lubricant composition was prepared by mixing the two ingredients physically prior to a melting process at 180° C. where sufficient time was given for the ingredients to intermix. This was followed by a slow cooling process until the room temperature was reached. The material was subsequently micronized to similar particle sizes as the first lubricant composition and admixed to the iron powder mixture.

The third lubricant composition was prepared in a similar way as the second, with the exception that the melted composition was forced through a narrow capillary into liquid nitrogen. A rapid cooling was thus achieved and material was finally micronized composition and admixed to the iron powder mixture as described above.

The results summarised in the following table demonstrated that a useful powder mixture is obtained only in the case of the rapid cooling.

| Lubricant | Initial melting of primary peak (° C.) | Flow (s/50 g) | AD (g/cm$^3$) |
|---|---|---|---|
| Rapid cooling | 107 | 29.7 | 2.99 |
| Physical mixing | 69 | No flow | 3.07 |
| Slow cooling | 59 | No flow | 2.95 |

What is claimed is:

1. Process for the preparation of a lubricant composite for powder metallurgy characterised in selecting a first lubricant having a melting point or a substantial part of its melting above 120° C. and a second lubricant having a melting point or a substantial part of its melting below 110° C.;

mixing the lubricants at an elevated temperature in order to melt the lubricants and subjecting the mixture to rapid cooling for providing a lubricant composite including a metastable phase.

2. Process according to claim 1 characterised in that the first lubricant is selected from the group consisting of saturated and unsaturated fatty acid amides and bis-amides, and the second lubricant is selected from the group consisting of fatty acid bis-amides.

3. Process according to claim 2 characterised in that the first lubricant is EBS and the second is oleamide.

4. Process according to claim 1 characterised in that said first lubricant is oleamide in an amount between 5 and 75% by weight of the total lubricant.

5. Lubricant composite for powder metallurgy characterised in that it essentially consists of a composite of at least two lubricants as defined in claim 1 and obtained by rapidly cooling a molten mixture of the lubricants.

6. Lubricant composite according to claim 5 characterised in that it includes a metastable phase of ethylene-bis-stearamide and oleamide.

7. Process according to claim 1 characterised in that the first lubricant is selected from the group consisting of stearamide, oleamide and ethylene-bis-oleamide and said second lubricant is ethylene-bis-stearamide.

8. Process according to claim 1 characterised in that said first lubricant is oleamide in an amount between 15 and 45% by weight of the total lubricant.

9. Process according to claim 1 characterised in that said first lubricant is oleamide in an amount between 20 and 30% by weight of the total lubricant.

* * * * *